US008726617B2

(12) United States Patent
Gustafsson

(10) Patent No.: US 8,726,617 B2
(45) Date of Patent: May 20, 2014

(54) METHOD AND DEVICE FOR FILLING OF CONTAINERS OF COLLAPSIBLE TYPE

(75) Inventor: Per Gustafsson, Bjärred (SE)

(73) Assignee: Ecolean AB, Helsingborg (SE)

( * ) Notice: Subject to any disclaimer, the term of this patent is extended or adjusted under 35 U.S.C. 154(b) by 0 days.

(21) Appl. No.: 12/680,063

(22) PCT Filed: Sep. 26, 2008

(86) PCT No.: PCT/SE2008/051085

§ 371 (c)(1),
(2), (4) Date: Mar. 25, 2010

(87) PCT Pub. No.: WO2009/041908

PCT Pub. Date: Apr. 2, 2009

(65) Prior Publication Data

US 2010/0199612 A1 Aug. 12, 2010

(30) Foreign Application Priority Data

Sep. 28, 2007 (SE) ..... 0702169

(51) Int. Cl.
*B65B 3/02* (2006.01)
*B65B 3/04* (2006.01)
*B65B 3/16* (2006.01)

(52) U.S. Cl.
USPC ..... 53/452; 53/558; 53/455; 53/543; 53/562

(58) Field of Classification Search
CPC ..... B65B 2220/22; B65B 43/123
USPC ..... 53/443, 452, 455, 477, 543, 558, 562
See application file for complete search history.

(56) References Cited

U.S. PATENT DOCUMENTS

| | | | | |
|---|---|---|---|---|
| 3,370,549 | A * | 2/1968 | Livingston | 104/212 |
| 3,955,334 | A * | 5/1976 | Wild et al. | 53/459 |
| 4,162,025 | A | 7/1979 | Achelpohl et al. | |
| 5,058,364 | A | 10/1991 | Seiden et al. | |
| 5,337,539 | A * | 8/1994 | Barton | 53/413 |
| 5,768,856 | A * | 6/1998 | Odenthal | 53/443 |
| 6,681,547 | B1 * | 1/2004 | Wild et al. | 53/410 |
| 6,834,755 | B2 * | 12/2004 | Jay | 198/418.6 |
| 6,874,298 | B2 * | 4/2005 | McMahon et al. | 53/412 |

(Continued)

FOREIGN PATENT DOCUMENTS

| | | | |
|---|---|---|---|
| EP | 1164081 | A1 | 12/2001 |
| EP | 1172295 | A1 * | 1/2002 |

(Continued)

*Primary Examiner* — Thanh Truong
*Assistant Examiner* — Eyamindae Jallow
(74) *Attorney, Agent, or Firm* — Volpe and Koenig, P.C.

(57) ABSTRACT

A method for filling containers of a collapsible type, including providing a web which includes the containers in an interconnected state, feeding the web for transporting the containers in a first direction, removing, during transport in the first direction, an end seal provided on each container for opening a filling duct, disengaging, during transport in the first direction, the containers from one another, and subsequently transporting the containers in a second direction transverse to first direction and filling, during the transport in the second direction, each container with a liquid product. The disclosure further relates to a device for filling containers of a collapsible type.

12 Claims, 1 Drawing Sheet

(56) References Cited

U.S. PATENT DOCUMENTS

| | | | | |
|---|---|---|---|---|
| 7,021,036 | B2 * | 4/2006 | Hiramoto et al. | 53/562 |
| 7,464,804 | B2 * | 12/2008 | Honeycutt | 198/418.6 |
| 7,469,522 | B2 * | 12/2008 | Dettwiller | 53/558 |
| 7,856,797 | B2 * | 12/2010 | Black et al. | 53/447 |
| 2003/0154697 | A1 | 8/2003 | Pellicer Thoma | |
| 2008/0313998 | A1 * | 12/2008 | Ligon et al. | 53/455 |
| 2009/0056281 | A1 * | 3/2009 | Murray | 53/455 |
| 2009/0241472 | A1 * | 10/2009 | Lindee et al. | 53/443 |

FOREIGN PATENT DOCUMENTS

| | | | |
|---|---|---|---|
| ES | 2098169 | A1 | 4/1997 |
| GB | 1381796 | A1 | 1/1975 |
| WO | 9941149 | A1 | 8/1999 |
| WO | 9941155 | A1 | 8/1999 |

* cited by examiner

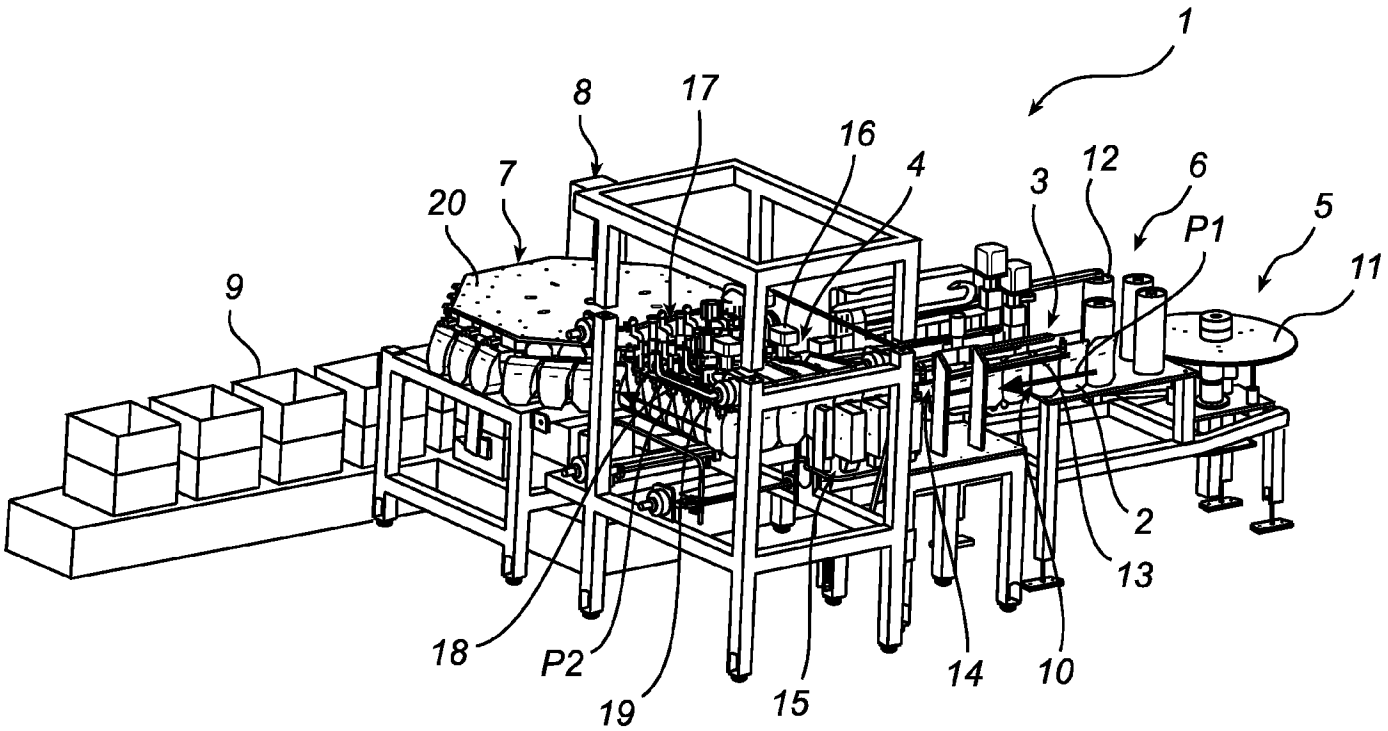
1
5
11
6
P1
12
3
2
13
10
14
4
16
15
17
19
8
P2
7
18
20
9

METHOD AND DEVICE FOR FILLING OF CONTAINERS OF COLLAPSIBLE TYPE

TECHNICAL FIELD

The present invention relates to a method and a device for filling containers of a collapsible type, and more specifically a method and a device for filling containers of the kind provided in the form of a web of such containers connected to one another.

BACKGROUND ART

It has become increasingly common to package liquid products, in particular liquid food products such as water, milk, juice or wine, in containers of a collapsible type.

By a container of a collapsible type is meant a container having a compartment which is defined by flexible walls and whose volume is dependent on the relative position of the walls.

It is known to manufacture rolls consisting of webs of interconnected containers of the type described above rolled onto a bobbin and to arrange such a roll in a filling machine.

A filling machine of this kind is known, for example, from WO99/41149. The document discloses how the rolled-out web of containers is fed through the filling machine so as to arrive, in order of priority, at a station for removing an end seal and, thus, opening a filling duct in each container, at a station for filling each container and at a sealing station for sealing the filled containers.

Filling machines of the kind described above usually represent a relatively considerable investment and there is, thus, a need for filling machines of a simple, less expensive design as well as filling machines with a high filling capacity, i.e. which are capable of filling a comparatively large number of containers per time unit.

SUMMARY OF THE INVENTION

In view of the above, it is an object of the present invention to provide an improved method and an improved device for filling containers of a collapsible type.

A further object of the invention is to provide a method and a device which allow high-capacity filling of containers of a collapsible type.

To achieve at least one of these objects, and also other objects that will be evident from the following description, a method having the features as defined in claim 1 and a device having the features as defined in claim 6 are suggested according to the present invention. Different embodiments of the method will be evident from claims 2-5, which are dependent on claim 1, and different embodiments of the device will be evident from claim 7, which is dependent on claim 6.

More specifically, the present invention suggests a method for filling containers of a collapsible type, comprising the steps of providing a web which contains said containers in a interconnected state, feeding said web for transporting the containers in a first direction, which may be a longitudinal direction of the web. During the transport in said first direction, an end seal provided on each container is removed for opening a filling duct and the containers are disengaged from one another. In a subsequent step, the containers are transported in a second direction, which is transverse to said first direction and which may be a transverse direction relative to a longitudinal direction of the web. During the transport in said second direction, each container is filled with a liquid product.

A method which enables high-capacity filling of containers of a collapsible type is thus obtained. By removing said end seal during transport of the containers in the first direction, it is possible to open sealed containers in a rational way to allow filling thereof. During the transport in the first direction, the containers are also disengaged from one another. The transport direction then changes to the transverse second direction. Since containers of a collapsible type, in unfilled state, have a very small extent in the transverse direction, only a short displacement in said second direction is required for transporting a container between different steps. One measure during the transport in the second direction includes filling of the container.

According to one embodiment of the inventive method, said web is provided in the form of a roll. This allows rational distribution and handling of the unfilled containers.

According to a further embodiment of the inventive method, a second measure during the transport in the second direction includes sealing the filling duct of the filled container.

The present invention further suggests a device for filling containers of a collapsible type, a first transport unit for feeding a web formed of said containers in an interconnected state for transporting the containers in a first direction, and a second transport unit, which is arranged for receiving the containers from said first transport unit and for transporting the containers in a second direction transverse to the first direction. The first transport unit comprises a cutting station, which is arranged to remove an end seal of each container and, thereby, to open a filling duct therein, and a separating station, which is arranged to disengage the containers from one another. The second transport unit comprises a filling station for filling the containers and a sealing station for sealing the filling duct of each filled container.

A device which enables high-capacity filling of containers of a collapsible type is thus obtained. The cutting station allows the removal of said end seal during transport of the containers by means of the first transport unit in the first direction, which may be a longitudinal direction of the web, whereby it is possible to open sealed containers in a rational way to allow filling thereof. During the transport in the first direction, the containers also pass a separating station for disengaging the containers from one another. The containers are then handled by the second transport unit and transported in the transverse, second direction, which may be a transverse direction relative to a longitudinal direction of the web. Since containers of a collapsible type, in unfilled state, have a very small extent in the transverse direction, only a short displacement in said second direction is required to transport a container between different stations. One station along the path in the second direction is a filling station for filling the container and another is a sealing station for sealing the filling duct of the filled container.

According to one embodiment of the present invention, the device comprises a receiving unit for receiving a roll formed of said web of containers in a rolled-up state.

BRIEF DESCRIPTION OF THE DRAWINGS

One embodiment of the present invention will now be described by way of example with reference to the accompanying drawing, in which FIG. 1 is a perspective view of an embodiment of an inventive device for filling containers of a collapsible type.

DESCRIPTION OF EMBODIMENTS

With reference to FIG. 1, an inventive device 1 for filling containers 2 of a collapsible type is shown.

The device 1 comprises, as main components, a first transport unit 3 and a second transport unit 4. The inventive device 1 may further comprise additional units and, in the embodiment shown, the device also comprises a receiving unit 5, a buffer unit 6 and a discharge unit 7.

The illustrated device 1 is intended for receiving the containers 2 in said receiving unit 5, wherefrom the containers 2 are forwarded to the first transport unit 3 via the buffer unit 6. The containers 2 are then conveyed to the second transport unit 4 before being, finally, applied to the discharge unit 7, adjacent to which a packing device 8 is arranged for arranging the filled containers 2 in distribution units, such as boxes 9.

More specifically, the receiving unit 5 is arranged to receive a roll (not shown) comprising a web 10 formed of said containers 2 in an interconnected state.

Each container 2 is a of a collapsible type and has a compartment which is defined by walls and whose volume is dependent on the relative position of the walls. The container type is also referred to as a "stand-up pouch". In their rolled-up state, the containers 2 are sealed, i.e. the compartments of the containers 2 are not in contact with the surroundings. As a result, it is possible to sterilize the compartments of the containers 2 during manufacture of the containers 2 and to distribute the roll of containers 2 in this sterile condition to, for example, a dairy plant.

In the embodiment shown, the receiving unit 5 comprises a rotatable disc 11 adapted to receive the roll of containers 2.

The buffer unit 6 is arranged immediately downstream of the receiving unit 5, as seen in the transport direction of the containers 2. The buffer unit 6 is capable of accomodating, if required, the web 10 of containers 2 rolled out from the receiving unit 5, and consists to this end of a plurality of deflection rollers 12 on which the web is conveyed. One of these deflection rollers 12 is movable, and by displacing the movable deflection roller, the distance along which the web 10 is conveyed through the buffer unit 6 may be increased or decreased.

The first transport unit 3 is arranged downstream of the buffer unit 6. In the embodiment shown, the transport unit 3 is arranged to transport the web 10 of containers 2 in a first direction P1. To this end, the first transport unit 3 is arranged for linear feeding of the web 10 in said first direction P1, which also corresponds to the longitudinal direction of the web 10.

Said first transport unit 3 may be arranged to continuously or intermittently feed said web 10 in said first direction P1.

In the case where the first transport unit 3 is arranged for intermittent feeding of the web 10, as is the case in the embodiment shown, the transport unit 3 may comprise a gripping means 13, which is adapted to grip the web 10. The gripping means 13 is operable between an open and a closed position and adapted to perform a reciprocating motion. More specifically, the gripping means 13 is adapted to be actuated so as to assume its closed position for gripping a top portion of the web 10 and then to be moved in said first direction P1 for feeding of the web 10. Next, the gripping means 13 is adapted to be actuated so as to assume its open position and to be returned to the initial position, after which the cycle is repeated.

The first transport unit 3 is arranged to transport the containers to a cutting station 14, which is arranged to remove an end seal of a filling duct of each container 2. By removing said end seal a contact is established between the compartment of the container 2 and the surroundings via the filling duct. To this end, the cutting station 14 may comprise a stationary cutter element (not shown), which is arranged to engage the web 10 to cut away a top strip during feeding of the web 10. The top strip comprises the end seals provided on the filling ducts of the different containers 2.

Furthermore, the first transport unit 3 is arranged to transport the web of containers 2 to a separating station 15, which is arranged to disengage the containers 2 from one another. The separating station 15 may comprise a cutter element (not shown), which is adapted to be moved into engagement with the part of the web 10 of containers that has arrived at the separating station 15 for disengaging the containers 2. Where the web of containers 2 is intermittently fed, the cutter element may be arranged to engage the web 10 when it is not moving, which is the case when the first transport unit 3 has released the web 10 in order to perform its retracting motion.

Finally, the first transport unit 3 is arranged to transport the containers 2 that have been disengaged from one another to a pick-up position, in which the containers 2 are handled by the second transport unit 4.

Thus, the second transport unit 4 is arranged downstream of the first transport unit 3.

Moreover, the second transport unit 4 is arranged to transport the containers 2 in a second direction P2 transverse to said first direction P1. In the embodiment shown, the transport unit 4 is arranged to transport said containers 2 to a filling station 16 and a sealing station 17.

The filling station 16 is arranged to fill of each container 2 through a filling duct associated therewith. The sealing station 17 is arranged to seal each filling duct after filling has been completed.

The second transport unit 4 may be arranged to transport the containers 2 to additional stations. For example, an opening station may be arranged upstream of the filling station, said opening station being adapted to separate side wall portions of each container to open the filling duct. This facilitates the insertion of a filling tube into the filling duct when filling the container at the subsequent filling station 16. In addition, stations may be provided for gas filling of a handle portion of each container.

The second transport unit 4 may be arranged for stepwise feeding of the containers 2 in said second direction P2, one step corresponding to the displacement from one station to the next.

The second transport unit 4 may be arranged to handle a plurality of containers 2 in the same step. In the embodiment shown, the second transport unit 4 handles containers 2 in groups of three.

The second transport unit 4 may further be arranged to transport the containers 2 between the stations along a curved path of movement, in such a manner that each container 2 upon arrival at a station has an upwardly directed component of movement. In this way, it is possible to have the container 2 dock with the station.

In the embodiment shown, the second transport unit 4 comprises a supporting structure 18, which is excentrically carried on rotatable mounts. The supporting structure 18 carries, in turn, a plurality of pinching means 19. By rotating said mounts, a circular movement is imparted to the supporting structure 18, and thus to each pinching means 19. The pinching means 19 ensure the transport of the containers 2 to a respective station. Each pinching means 19 is arranged to handle containers 2 in groups of three. More specifically, each pinching means 19 is arranged to be given a circular, counter-clockwise movement, the containers 2 being gripped by the pinching means 19 in a position corresponding to nine o'clock, transported along a curved path of movement and arriving at the station concerned in a position corresponding to three o'clock. In this way, the stepwise feeding of the containers 2 as well as the vertical component of movement upon arrival of the containers 2 to the respective station are obtained.

The second transport unit 4 is arranged to finally move the filled and sealed containers 2 to a delivery position, at which the discharge unit 7 takes over the handling of the containers 2. This discharge unit 7 may have different designs and, in the embodiment shown, the discharge unit 7 consists of a horizontal, octagonal indexing wheel 20, each side edge of which is arranged to handle a group of containers 2 transferred to the delivery position. It will be appreciated, however, that other designs of the discharge unit 7 are conceivable. The discharge unit may, for example, be arranged to feed the containers 2 in a direction parallel to the first direction P1 by means of a device similar to the above-described gripping means 13 of the first transport unit 4.

The indexing wheel 20 is stepwise rotated so as to transport the groups of containers 2 to a position in which the packing device 8 grabs the containers 2 and places them in boxes 9.

In this manner, according to the invention a device 1 for filling containers 2 of a collapsible type is obtained. The device 1 is adapted to transport the containers 2 in a first direction P1 and then in a second direction P2 transverse to the first direction P1. By transporting the containers in different directions P1, P2, it is possible to optimize the various measures required for filling the containers 2.

A web 10 of interconnected and sealed containers 2 is provided in the form of a roll, and the device 1 comprises a first transport unit 3 for transporting the rolled-out web 10 in a first direction P1, which corresponds to the longitudinal direction of the web 10.

During the transport in said first direction P1, the containers 2 pass a cutting station 14, which is arranged to remove an end seal of a filling duct of each container 2. By using the linear feeding of the web 10 in said first direction P1, it is relatively easy to have the cutting station 14 perform said removal of the end seals.

During the transport in said first direction P1, the containers 2 also pass a separating station 15 for disengaging the containers 2 from one another.

Once the containers 2 have been disengaged from one another, they are then moved to a pick-up position, in which a second transport unit 4 takes over the handling of the containers 2.

The second transport unit 4 is arranged to transport the containers 2 in a second direction P2 transverse to said first direction P1. The containers 2 are stepwise transported to at least one filling station 16 and one sealing station 17. Accordingly, the second transport unit 4 is arranged for lateral transport of the containers 2. As stated above, the containers 2 are of a collapsible type and are, thus, in a flat state before filling. By transporting the containers 2 laterally, i.e. in the direction in which the unfilled containers 2 have a very small extent, the distance that each container 2 must travel from one station to another is minimized. This is because the distance cannot be smaller than the extent of the container 2 in the current transport direction. Since the lateral displacement required for transporting a container 2 from one station to another is short, the containers 2 can be moved between the stations in a time-saving manner.

It will be appreciated that the present invention is not limited to the embodiment shown. Several variations and modifications are thus conceivable and therefore the scope of the present invention is thus defined solely by the appended claims.

The invention claimed is:

1. A method for filling containers of a collapsible type, comprising:

on a first transport unit:

providing a web, which includes said containers in an upright and interconnected state, feeding said web for transporting the containers in a first horizontal direction, whereby the containers are in a fixed orientation relative to said first horizontal direction, removing, during said transport in said first horizontal direction, an end seal provided on each container for opening a filling duct, disengaging, during said transport in said first horizontal direction, the containers from one another, and on a second transport unit;

subsequently transporting the containers, while maintaining their fixed orientation relative to said first horizontal direction, in a second horizontal direction transverse to said first horizontal direction, the second transport unit configured for stepwise transportation of the containers as groups of containers, in the second horizontal direction, with each group being a predetermined number of containers aligned in the first horizontal direction as the group is transported in the second horizontal direction, and filling, during the transport in said second horizontal direction, each container with a liquid product.

2. A method according to claim 1, in which said web is provided in the form of a roll.

3. A method according to claim 1, further comprising sealing, during the transport in said second direction, the filling duct of each container.

4. A method according to claim 1, in which said first direction is a longitudinal direction of the web.

5. A method according to claim 1, in which said second direction is a transverse direction relative to a longitudinal direction of said web.

6. Device for filling containers of a collapsible type, comprising:

a first transport unit, which is arranged to feed a web formed of said containers in an upright and interconnected state for transporting the containers in a first horizontal direction, the containers being in a fixed orientation relative to said first horizontal direction, said first transport unit having:

a separating station, which is arranged to disengage the containers from one another, and a second transport unit, which is arranged to receive the containers from said first transport unit and to transport the containers in a second horizontal direction transverse to the first horizontal direction, the second transport unit configured for stepwise transportation of the containers as groups of containers, in the second horizontal direction, with each group being a predetermined number of containers aligned in the first horizontal direction as the group is transported in the second horizontal direction, said second transport unit having:

a filling station for filling the containers, and a sealing station for sealing a filling duct of the respective filled container, the first transport unit further having a cutting station, which is arranged to remove an end seal of each container and, thereby, open the filling duct of each container, and the second transport unit is arranged to transport the containers in said second horizontal direction while maintaining the fixed orientation of the containers relative to said first horizontal direction.

7. A device according to claim 6, further comprising a receiving unit for receiving a roll formed of said web of containers in a rolled-up state.

8. A method according to claim 2, further comprising sealing, during the transport in said second direction, the filling duct of each container.

9. A method according to claim 2, in which said first direction is a longitudinal direction of the web.

10. A method according to claim 3, in which said first direction is a longitudinal direction of the web.

11. A method according to claim 2, in which said second direction is a transverse direction relative to a longitudinal direction of said web.

12. A method according to claim 3, in which said second direction is a transverse direction relative to a longitudinal direction of said web.

* * * * *